US005207315A

United States Patent [19]

Benda

[11] Patent Number: 5,207,315

[45] Date of Patent: May 4, 1993

[54] CIRCUIT BREAKER BLOCK OUT

[76] Inventor: Steven J. Benda, P.O. Box 782, Cokato, Minn. 55321

[21] Appl. No.: 776,184

[22] Filed: Oct. 15, 1991

[51] Int. Cl.[5] ..... H01H 27/10

[52] U.S. Cl. ..... 200/43.11; 200/43.13; 200/43.15; 200/43.16; 200/43.19; 70/164; 70/DIG. 30

[58] Field of Search ..... 200/43.01, 43.11, 43.13, 200/43.14, 43.15, 43.16, 43.17, 43.18, 43.19, 43.21, 43.22, 308, 318.1, 327; 70/DIG. 30, 158, 159, 163, 164, 18, 232; 292/307 B, , 317, 321

[56] References Cited

U.S. PATENT DOCUMENTS

| | | | |
|---|---|---|---|
| 1,829,444 | 10/1931 | Goebel et al. | 70/158 |
| 2,983,799 | 5/1961 | Osieja et al. | 200/43.15 |
| 3,214,530 | 10/1965 | Tharp et al. | 200/43.15 |
| 3,245,240 | 4/1966 | De Forrest | 70/158 |
| 3,388,224 | 6/1968 | Higgins | 200/43.13 |
| 4,260,861 | 4/1981 | DiMarco | 200/43.15 |
| 4,281,228 | 7/1981 | Harmon | 200/308 X |
| 4,552,394 | 11/1985 | Kesselman | 292/307 B |
| 4,677,261 | 6/1987 | Nourry | 200/43.15 |
| 5,039,829 | 8/1991 | Brucksch | 200/43.21 X |
| 5,122,624 | 6/1992 | Berda | 200/43.14 |

FOREIGN PATENT DOCUMENTS

| | | | |
|---|---|---|---|
| 404976 | 9/1968 | Australia | 200/43.21 |
| 172771 | 2/1986 | European Pat. Off. | 200/43.11 |
| 2635910 | 3/1990 | France | 200/43.11 |
| 2130147 | 5/1984 | United Kingdom | 292/307 B |
| 2130148 | 5/1984 | United Kingdom | 292/307 B |

*Primary Examiner*—Henry J. Recla
*Assistant Examiner*—Glenn T. Barrett
*Attorney, Agent, or Firm*—Paul H. Gallagher

[57] ABSTRACT

A one-piece integral molded plastic article, includes a pair of main parts hinged together, which enclose the actuating element of the circuit breaker and holds it against movement. One form is for push-pull type circuit breakers. Another form includes soft inserts which grip the actuating element and hold it. Another form includes a separate cap which is applied semi-permanently to the actuating members. Latching means latches the main parts together, which hold them in normally latched position, and a padlock locks them together.

13 Claims, 3 Drawing Sheets

CIRCUIT BREAKER BLOCK OUT

CROSS REFERENCE

My prior and co-pending application Ser. No. 07/644,554 filed Jan. 23, 1991, U.S. Pat. No. 5,122,624 date Jun. 16, 1992.

BRIEF SUMMARY OF THE INVENTION

The present invention resides in the same general field as that of my prior application identified above. Specifically, the invention finds most effective use in the case where a plurality of circuit breakers are involved, and it is desired to open, or block out, certain ones. This particular arrangement is found most often in industrial and commercial establishments, where such plurality of circuit breakers are used, and many times a large number of them. As in the case of the previous invention, when a plurality of circuit breakers are involved, it is usually necessary and desired to block out only certain ones of them. The device of that invention is adaptable to be applied to individual circuit breakers very effectively, and the device of the present invention is more flexible in being so applied.

A principal object of the present invention is to provide a circuit breaker block out that is more readily adaptable to circuit breakers of a great variety of kinds and sizes, than any devices heretofore known.

Another object is to provide such a block out that is easily locked in place, on a circuit breaker that is blocked out, and that can be very securely so locked in place.

Still another object is to provide such a block out having novel special form which adapts it to a plunger type circuit breaker.

DETAILED DESCRIPTION

Figure 9:
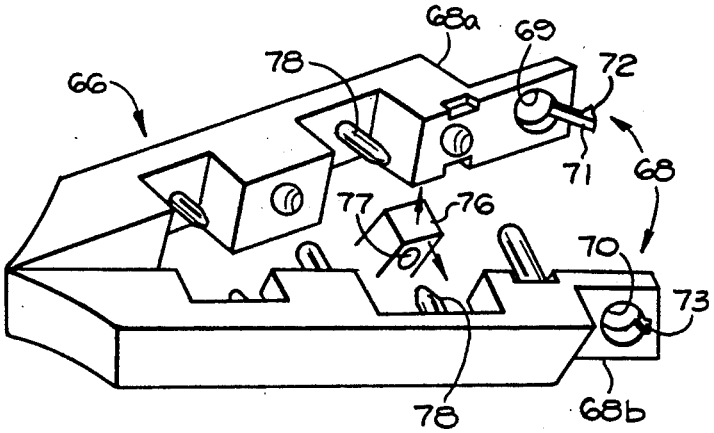
FIG. 9 is a perspective view of a second form of block out, in a partially folded position.
Figure 11:
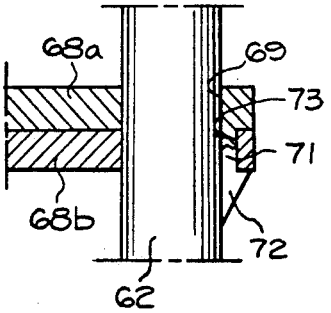
FIG. 11 is a view similar to FIG. 8 but showing the latching finger in an opposite location.
Figure 10:
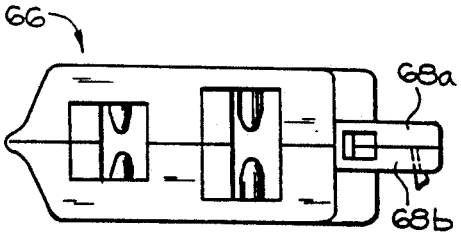
FIG. 10 is a top view of the block out of FIG. 9, applied to a circuit breaker.
Figure 12:
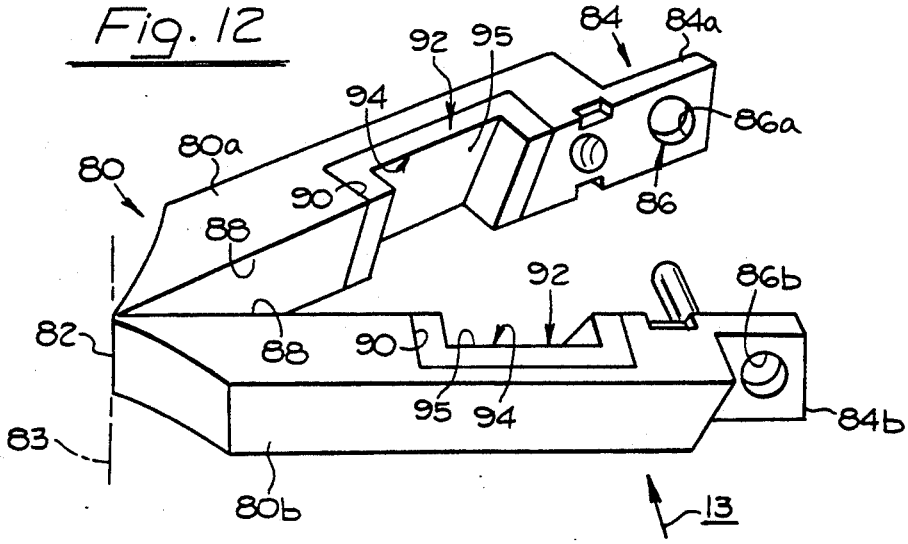
FIG. 12 is a perspective view of another form of block out, oriented in the same direction as in FIG. 9.
Figure 13:
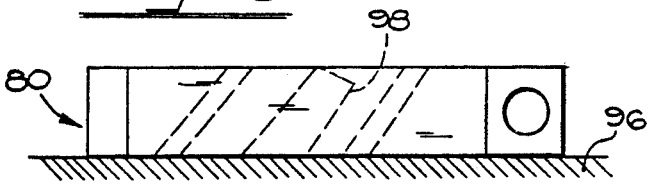
FIG. 13 is a side view of the device of FIG. 12, oriented by the arrow 13 in FIG. 12, and with the device applied to a circuit breaker.
Figure 14:
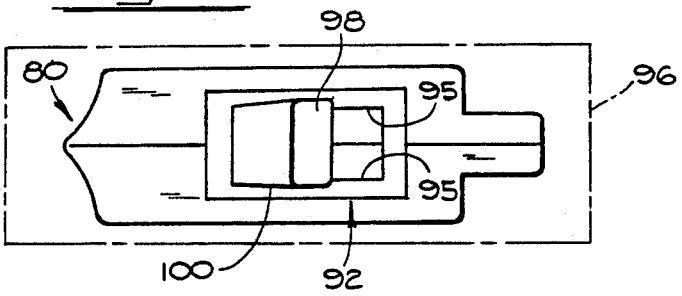
FIG. 14 is a top view of FIG. 13.
Figure 15:
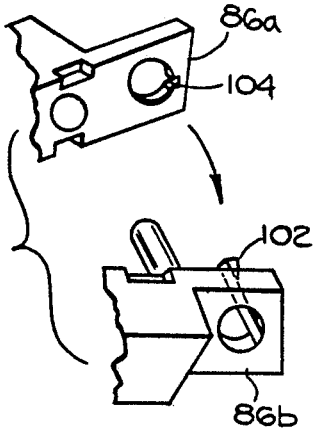
FIG. 15 is a perspective view, oriented according to FIG. 12, and showing a form slightly modified relative to that of FIG. 12.
Figure 16:
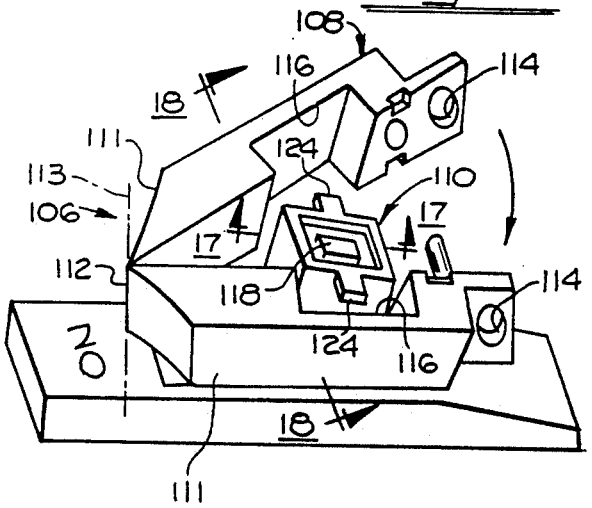
FIG. 16 is a prospective view, oriented according to FIG. 12, of another form of block out.
Figure 17:
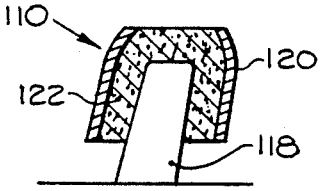
FIG. 17 is a sectional view taken at line 17—17 of FIG. 16.
Figure 18:
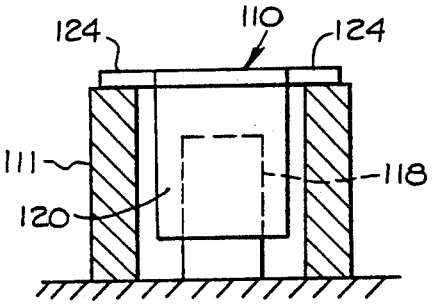
FIG. 18 is a sectional view taken at line 18—18 of FIG. 16.
Figure 19:
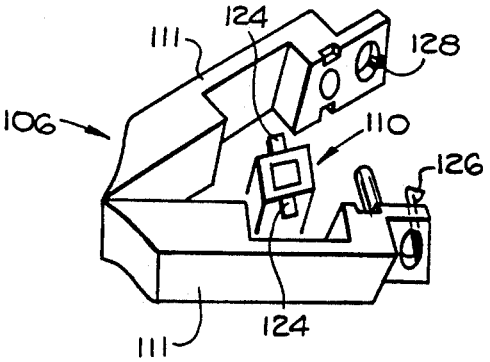
FIG. 19 is a perspective view, oriented in the direction of FIG. 16 and showing a form of block out slightly modified relative to that of FIG. 16.

Referring to the various devices in general, it is pointed out that a first form of block out is shown in FIGS. 1–8; a second form in FIGS. 9–11; a third form in FIGS. 12–14; a fourth form in FIG. 15; a fifth form in FIGS. 16–18; and a sixth form in FIG. 19. The various forms of the device disclosed herein perform the function of blocking out circuit breakers in that when the device is applied to a circuit breaker, and in the normal course of events, the circuit breaker is not intentionally actuated when the device is applied thereto. It may also be desirable at times to lock the device in place on the circuit breaker so as to prevent deliberate tampering and prevent its removal, without completely destroying it. In the forms of the device enabling locking, the device may be referred to as a lock out. Block out is used herein in a generic sense to cover both blocking out and locking out, while lock out is a specific form of the device, enabling locking thereof.

Referring in detail to the accompanying drawings, attention is directed first to the form shown in FIGS. 1–8. The block out of this form is shown in its entirety at 22, and the circuit breaker to which it is especially adapted is indicated at 24. This circuit breaker is of the push-pull kind, having a plunger type actuating element that is axially slidable. The circuit breaker includes a mounting means 26 and a main housing or body 28 including an element 30 of lesser diameter having an upper surface 31 forming a shoulder. The circuit breaker includes an actuating element, 32, in the body 28 but extending to the exterior and having a reduced shank portion 34 and a large head 36. The shank 34, is usually white in color and the other parts darker, providing a readily visual contrast. The actuating element 32 is slidable along its longitudinal axis 37 from an outer OFF position 32*a* shown in full lines, to an inner ON position 32*b*, shown in dot-dash lines.

Figure 4:
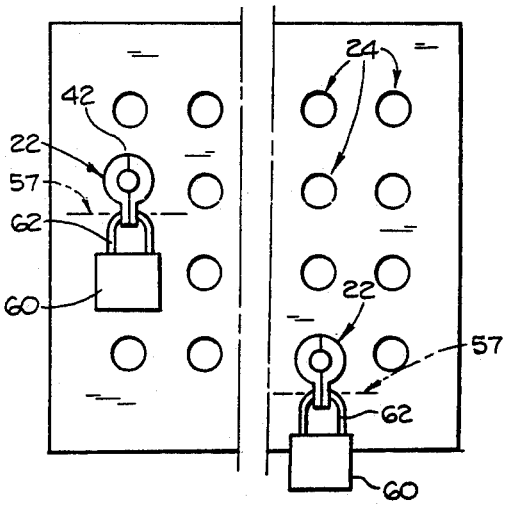
FIG. 4 is a face view of a panel or board having a plurality of circuit breakers thereon, of the type illustrated in FIG. 3.
Figure 5:
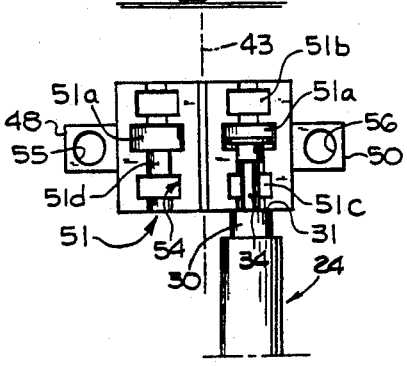
FIG. 5 is a view oriented according to FIG. 3, showing the upper part of the circuit breaker of FIG. 3, and the block out in open position in a step of applying it to the circuit breaker.

The block out 22 is a one-piece, integral member, made up of two main parts 38, 40 connected together by hinge means 42 on an axis 43 (FIG. 5). The parts are swingable from an open generally elongated flat condition (FIGS. 1, 5) to a closed locking position (FIG. 4) in which the parts are fitted together. The parts 38, 40 include large body portions 44, 46, together forming a generally cylindrical shape, and arms 48, 50 extending therefrom. The main parts have inner surfaces 49 which when the member is in locking position, interface, and substantially interengage.

Figure 6:
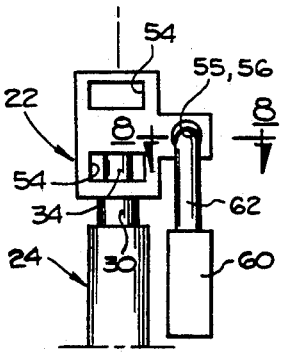
FIG. 6 is a view oriented according to FIG. 5 showing the block out in folded position and applied to the circuit breaker.
Figure 7:
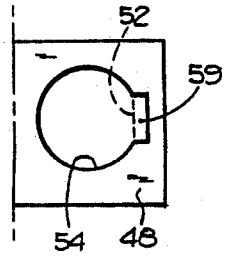
FIG. 7 is a view oriented to line 7—7 of FIG. 2.
Figure 8:
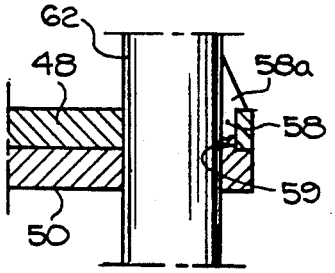
FIG. 8 is a view taken at line 8—8 of FIG. 6.

The large portions 44, 46 are provided with recesses 51 adapted to receive the exposed end of the actuating element 32, each including a central segment 51*a*, end segments 51*b*, 51*c* spaced from the central segment. The end segments open through the wall and form viewing ports or viewing windows 54 (FIG. 6). The central and end segments are interconnected by shank segments 51*d*. These recesses are arranged so that when the main parts are folded together with the inner surfaces 49 of the latter interengaging, they form circumferentially continuous cavities, and form apertures through the member on an axis 52 parallel with the axis 43 in the hinge means. The windows 54, which open into the end segments, visually expose the white shank 34, as referred to again hereinbelow. The central segment 51*a* is positioned closer to one end than the other, to accommodate actuating elements of different external extensions.

Figure 2:
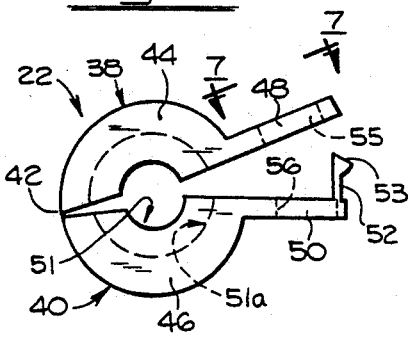
FIG. 2 is a view oriented according to FIG. 2, showing the device in partially folded form, in a step of its application to the circuit breaker.
Figure 1:
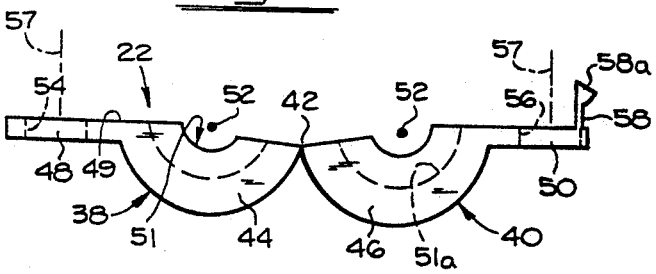
FIG. 1 is a top edge view of one form of the circuit breaker, of the invention.
Figure 3:
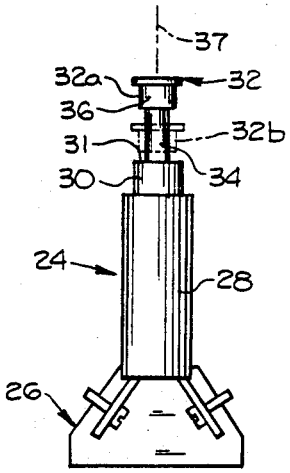
FIG. 3 is a side view of a plunger type circuit breaker with which the device of FIGS. 1 and 2 is adapted to be used.

The arms 48, 50 are provided with apertures 55, 56 adjacent their swinging ends, i.e., right hand ends in FIG. 2, which are aligned on a common axis 57 (FIGS. 4, 8) when the main parts are fitted together. One of the arms 48, 50 is provided with a latching finger 58 extending substantially perpendicularly therefrom, and in a direction perpendicular to the axis 43 of the hinge means 42. The latching finger 58 has a latch element 58*a* at its extended end.

The other arm, 48, is provided with a key way 59 (FIG. 7) arranged and positioned for receiving the latching finger 58 when the main parts are moved together to locking position. The latching finger penetrates through the key way 59, and the latching element 58*a* engages the arm 48 in a positive manner, preventing the main parts from being separated, while the finger is in latching position.

The latching finger 58 and key way 59 enable the latching finger 58 to be confined entirely in the key way, (FIG. 7), thereby providing a main portion of the aperture 54 that is substantially circular in form. For locking the device in locking position, a padlock 60 is utilized, the locking element 62 thereof being inserted through the apertures 54, 56, this element being round in cross section, and thereby engaging the latching finger and preventing it from being moved out of the key way. Thereby the latching finger remains latched, and the main parts of the device remain locked together.

In the use of the block out, it is applied to the actuating element 32 when the latter is in OFF or open position, and as illustrated here in the pulled-out position (FIGS. 3, 5), and in this position the white surface of the shank 34 is exposed upwardly beyond the element 30. Then the block out is applied to the circuit breaker by holding it open (FIGS. 1, 5), and one of the parts fitted to the actuating element, and the head 32 falls in the central recess 51*a*. The dimensions of the block out, and the position of the plunger, are such that when the head 32 is in the center recess 51*a*, the lower end surface of the block out 22 fits against the shoulder 31 of the large element 30, and it is understood that the head 32 is larger than the shank portion 51*d* and thus held in the large recess. Then the other main part is swung to closed position against the first part as indicated in FIG. 2 in which the parts are yet angularly spaced apart, but in a position in which the latching finger 58 is closely adjacent the aperture 56, and upon further movement of the parts together, the latching finger moves into the aperture, and latches. This position is shown in FIGS. 4 and 6. With the main parts thus fitted together, the recesses 51*a* together form a continuously circular cavity confining the head 32.

In this position of the block out, the latter reacts between the head 32 of the actuating element and the shoulder 31 and holds the actuating element in its outer position. In this position the white surface of the actuating element is exposed and viewable through the window 54 located on top of the shoulder 31 and thus forms a quick indication that the actuating element is in retracted or off position.

With the block out thus applied and without being locked, it is usable where it is believed no interference will take place, either deliberate or accidental. However, if it is feared that the block out may be tampered with, it may be locked as referred to above by means of the padlock 60 with the element 62 inserted through the aligned apertures 54, 56. This padlock of course prevents the complete spreading of the main parts of the device, but in order to prevent an unlikely situation such as using a pry and spreading the main parts apart, so that the plunger can be pushed to inner position, the latching finger 58 is utilized. As referred to above, with the padlock in place, the element 62 prevents the latching finger from being unlatched, and the main parts from being pried apart.

Reference is next made to the form of the device shown in FIGS. 9–11. FIG. 9 shows a block out 66 identical with the block out of my prior application identified above, with the exception of a latching finger 71. In the present case the block out includes two main parts 68, individually identified 68*a*, 68*b* corresponding with the main parts 31*a*, 31*b* in that application. In the present case the main parts are provided with apertures 69, 70 at their swinging ends. The main part 68*a* has a latching finger 71 with a latching element 72, and the main part 68*b* has a key way 73 into which the latching finger moves, in the same manner as described above in connection with the form of FIGS. 1–8. The locking position of the latching finger is shown in FIG. 10. FIG. 11 shows the element 62 of the padlock 60 in position in the apertures and holding the latching key in latching position.

For the purpose of bringing out certain significant features in the forms of device of FIGS. 12 and 16, it is pointed out that the device of FIG. 9, and that of my prior application, is for use with a circuit breaker having an actuating element with holes therein. FIG. 9 shows such an actuating element 76 with holes 77 in the sides thereof. The block out device 66 has pins 78 which extend into those holes, when the device is applied to the circuit breaker. This provides a positive locking feature. However the actuating elements are provided with such holes only in certain cases. In the absence of such holes, it is necessary to provide other means for producing a holding or gripping effect on the actuating elements, and a feature for providing this effect is incorporated in the forms of FIGS. 12 and 16. Detail reference is now made to the device of FIG. 12, which is identified 80 and has two main parts 80*a* and 80*b*. They are connected together by hinge means 82 on an axis 83, of the kind referred to above, and thus form levers, having swinging ends 84 individually identified 84*a*, 84*b*. These swinging ends have apertures 86 individually identified 86*a*, 86*b*, which are disposed on a common axis when the device is in locking position, similarly to the forms described above.

The main parts 80*a*, 80*b* have interfacing surfaces 88 in which are formed recesses 90 extending through the main parts in direction parallel with the axis 83, and being of such lengths, longitudinally of the main parts, and of such depth, transversely thereof, to correspond with the actuating element of the circuit breaker.

Positioned in these apertures 90 are inserts or liners 92, which themselves have recesses 94 shaped similarly to the recesses 90, and opening through the interfacing surfaces 88, and thus interfacing, and when the main parts are in locking position, together form an aperture through the device in direction parallel with the axis 83. These recesses 94 have floors or bottom surfaces 95.

FIGS. 13 and 14 show the device 80 applied to a circuit breaker 96 which has an actuating element 98 in the form of a swinging lever. It is so applied to the circuit breaker by moving the main parts to closed position with the actuating element 98 therebetween, in the recesses 94.

The main parts 80, without the inserts 92, are of molded plastic, preferably polypropylene, and are relatively hard, and rigid and non-yielding, and have only a limited amount of flexibility. The inserts 92 are, by contrast, relatively yielding, and softer than the material of the main parts. These inserts are bonded to the main parts, in a known process, and provide what is known as dual plastic consistency.

When the device is applied to the circuit breaker, the actuating element 98 is gripped between the inserts, and the relative dimensions are such that the floors 95, in their normal condition and shape, are spaced apart in the locking position of the device, a distance less than the corresponding dimensions of the actuating lever. The material of the inserts yields slightly, as shown at 100 in FIG. 14, and the inserts thereby grip the actuating element with great force, and thereby prevent movement of the actuating lever. In the absence of the holes 77 (FIG. 9) the friction gripping action of the inserts provides the desired locking effect. This locking effect prevents the swinging or angular movement of the actuating element. The block out remains in its original predetermined position relative to the actuating element by engaging the surface of the circuit breaker 96 (FIG. 13) throughout its length, and in that manner prevents the angular movement of the actuating element.

The form as shown in FIGS. 12–15, may have, or not have, a latching finger, as desired. The form of FIGS. 12–14 does not have such a latching finger, but FIG. 15 shows the same form, but with a latching finger 102 adjacent the aperture **86*b*, and a key way 104 in the aperture 86*a***.

Detail reference is next made to the form of the device of FIGS. 16–19. In this embodiment, the block out device is indicated in its entirety at 106, and includes a major component 108 and a cap 110. The major component 108 is a one-piece molded article, having a pair of main parts 111 connected together by hinge means 112 on an axis 113, similar to the devices described above. The main parts 111 have apertures 114 at their swinging ends, and have recesses 116 in their interfacing surfaces.

The cap 110 is separate from the main component 108, and is applied directly to the actuating lever 118 of the circuit breaker. The cap has a surrounding wall 120 (FIG. 17) with an aperture therethrough, and is fitted to the actuating element by extending the actuating element through the aperture, and then a mass of bonding material 122 such as epoxy is put in the cap around the actuating element, which bonds the cap securely thereto. The main parts 111 are then fitted to the cap, with the latter received in the recesses 116. The surrounding wall has lugs 124 at the top which extend over the corresponding surfaces of the main parts 111 (FIG. 18) and provide a positive locking effect, preventing the main parts from being lifted up and off the circuit breaker.

In this case also, it is understood that the actuating element of the circuit breaker does not have holes such as 77 in FIG. 9 and the cap bonded to the actuating lever provides the means for the device to effectively grip the actuating lever.

In the use of this device a lock such as the padlock 60 may be utilized, with the apertures 114 for locking the device in place.

The device as illustrated in FIGS. 16–18 is not provided with latching means, but in this case also, such latching means may be provided as in FIG. 19 where a latching finger 126 is provided on the swinging end of one of the main parts, and a key way 128 is provided in the aperture in the other part, in the same kind of construction as in the previous embodiments.

I claim:

1. A block out device for use with a circuit breaker having a body presented to a user, and having an actuating element extending through the body and thereby accessible for actuation by the user, and movable between opposite positions, said block out device comprising, a one-piece member having a pair of opposed main parts connected together by hinge means having an axis, said pair of main parts having swinging ends movable toward each other to a locking position wherein they are substantially in interengagement, and away from each other to a non-locking position, the main parts, when the device is applied to a circuit breaker and the main parts are in locking position, are adapted to engage said actuating element and prevent movement of said element between said opposite positions, the main parts having cooperating apertures located at their swinging ends adapted to receive a locking element of predetermined dimensions, said cooperating apertures having a common axis when in said locking position, such that said apertures are in alignment and said axis is perpendicular to an axis extending parallel with the axis of the hinge means, and a first of the main parts including a latching element extending through the aperture of a second of the main parts and engaging the second main part in a latching position, for holding the main parts in locking position, said second main part having a key way located in a surface of the aperture therein, and the latching element being positioned within said key way when in said latching position, the apertures being of such size that when the locking element is in said apertures, the latching element is effectively engaged by the locking element and held in said key way and thereby held in latching position, the block out device having locking connection with the actuating element and is operable for locking the actuating element, only by locking engagement therewith.

2. A block out device according to claim 1 adapted for use with a circuit breaker of the kind having a plunger type actuating element movable axially in its said body between on and off positions, wherein, the main parts have recesses between the hinge means and their swinging ends that interface when the main parts are in locking position, which receive the actuating element therein, the main parts thereby react between the actuating element and the body and prevent movement of the actuating element.

3. A block out device according to claim 1 wherein the actuating lever pivots about an axis adjacent to the body, between opposite positions spaced apart angularly, said block out device further comprising, the main parts having recesses therein that interface when the one-piece member is in said locking position, the recesses together forming an aperture through the one-piece member, wherein the aperture is adapted to receive the actuating lever, the device including means located, in the recesses adapted for gripping the actuating lever, such that said actuating lever is prevented from moving to its opposite position when positioned within said recess.

4. A block out device according to claim 3 wherein, the gripping means is formed from a yieldable material is adapted to frictionally engage said actuating lever for holding the actuating lever against movement.

5. A block out according to claim 4 wherein, the one-piece member is formed from plastic, and the gripping means is formed from a relatively high yieldability plastic bonded to the plastic of the one-piece member.

6. A block out device according to claim 5 wherein, the gripping means is made up of a pair of separate pieces, one in each of the recesses, and said separate pieces also have recesses therein, which interface when the main parts are in locking position, and which form said aperture.

7. A block out device according to claim 3 wherein, the gripping means is separate from the one-piece member and includes means adapted for securing said gripping means to said actuating lever, and the gripping means and the one-piece member have interengaging elements, operable, when the main parts are in locking position, for preventing removal of the one-piece member from the circuit breaker.

8. A block out device according to claim 7, wherein, the gripping means includes a surrounding shell having an aperture adapted for receiving the actuating lever, the gripping means includes a moldable material located in the shell and adapted for surrounding and gripping the actuating lever and the shell and thereby securing the shell to the actuating lever, and said interengaging elements including ears on the shell engaging the one-piece member.

9. A block out device for use with a circuit breaker of the kind having a plunger type actuating element movable axially in a body between on and off positions, the actuating element having a larger head exposed to an exterior of the body, said block out device comprising, a one-piece member including a pair of main parts hinged together by hinge means and having a pair of swinging ends, the main parts being movable between locking and non-locking positions, wherein said main parts are in interengagement when in said locking position, the main parts having recesses therein that are in alignment when the main parts are in said locking position, and the aligned recesses are adapted to receive said head on the actuating element, whereby said member is adapted to prevent axial movement of the actuating element when said actuating element is positioned within said aligned recesses, and the main parts having means located on said swinging ends adapted for operably mounting locking means for holding the main parts together in locking position.

10. A block out device according to claim 9 wherein, the recesses, when the main parts are in locking position, together form an aperture through the member concentric with the actuating element.

11. A block out device according to claim 10 wherein, the actuating element includes a reduced dimension shank on which the head is positioned, and wherein, the recesses include large and small segments adapted for receiving the head and shank respectively.

12. A block out device according to claim 11 wherein, the recesses are so dimensioned and positioned that, when the main parts are in locking position, they form apertures through the member having a large central segment and small end segments spaced therefrom interconnected by smaller shank segments, axially aligned.

13. A block out device according to claim 12 wherein, the end segments of the aperture are spaced at different distances from the central segment.

* * * * *